US008987622B2

(12) United States Patent
Ando

(10) Patent No.: US 8,987,622 B2
(45) Date of Patent: Mar. 24, 2015

(54) SWITCH

(71) Applicant: Kabushiki Kaisha Yaskawa Denki, Kitakyushu-shi (JP)

(72) Inventor: Norio Ando, Fukuoka (JP)

(73) Assignee: Kabushiki Kaisha Yaskawa Denki, Kitakyushu-Shi (JP)

( * ) Notice: Subject to any disclaimer, the term of this patent is extended or adjusted under 35 U.S.C. 154(b) by 157 days.

(21) Appl. No.: 13/779,784

(22) Filed: Feb. 28, 2013

(65) Prior Publication Data

US 2014/0076702 A1 Mar. 20, 2014

(30) Foreign Application Priority Data

Sep. 20, 2012 (JP) ..... 2012-207493

(51) Int. Cl.

| | |
|---|---|
| ***H01H 23/00*** | (2006.01) |
| ***H01H 23/16*** | (2006.01) |
| ***H01H 3/44*** | (2006.01) |
| ***H01H 31/00*** | (2006.01) |
| ***H01H 3/36*** | (2006.01) |
| *H01H 3/42* | (2006.01) |
| *H01H 9/28* | (2006.01) |

(52) U.S. Cl.

CPC ..... *H01H 23/168* (2013.01); *H01H 3/42* (2013.01); *H01H 3/44* (2013.01); *H01H 9/281* (2013.01); *H01H 31/003* (2013.01); *H01H 3/36* (2013.01)

USPC ..... 200/401

(58) Field of Classification Search

CPC ..... H01H 3/44; H01H 3/36; H01H 3/42; H01H 23/168; H01H 31/003; H01H 9/281

USPC ..... 200/401

See application file for complete search history.

(56) References Cited

U.S. PATENT DOCUMENTS

| | | | | |
|---|---|---|---|---|
| 5,571,255 | A * | 11/1996 | Baginski et al. | 200/401 |
| 6,940,032 | B2 * | 9/2005 | Sirajtheen et al. | 200/400 |
| 7,268,652 | B2 * | 9/2007 | Marks et al. | 335/6 |
| 8,183,487 | B2 * | 5/2012 | Lee | 200/401 |

FOREIGN PATENT DOCUMENTS

| | | |
|---|---|---|
| JP | 06-009031 U | 2/1994 |
| JP | 10-188744 | 7/1998 |
| JP | 10-321090 | 12/1998 |
| JP | 2011-146199 | 7/2011 |
| WO | WO 2006/067936 | 6/2006 |

OTHER PUBLICATIONS

Japanese Office Action for corresponding JP Application No. 2012-207493, Jan. 14, 2014.

* cited by examiner

*Primary Examiner* — Kyung Lee
(74) *Attorney, Agent, or Firm* — Mori & Ward, LLP

(57) ABSTRACT

A switch according to the embodiment includes a first contact that switches between an open state and a closed state, a second contact that switches between an open state and a ground state, an operating lever, and a rotating member that rotates for a predetermined angle in accordance with an operation of the operating lever. Furthermore, the switch includes a first cam that opens and closes the first contact by rotating in conjunction with a rotation of the rotating member in one direction, and a second cam that opens and closes the second contact by rotating in conjunction with a rotation of the rotating member in another direction.

14 Claims, 8 Drawing Sheets

SWITCH

CROSS-REFERENCE TO RELATED APPLICATION

This application is based upon and claims the benefit of priority of the prior Japanese Patent Application No. 2012-207493, filed on Sep. 20, 2012, the entire contents of which are incorporated herein by reference.

FIELD

The embodiment discussed herein is directed to a switch.

BACKGROUND

Conventional switches used in electrical transformation installations or the like include a gas insulated switch. An example of such a switch is a known switch in which a common operating device causes a first contact, which switches between the open state and the closed state, and a second contact, which switches between the open state and the ground state, to perform a switching operation.

Literature related to the above conventional technology includes, for example, Japanese Patent Application Laid-open No. 2011-146199.

Conventional switches, including the switch disclosed in the above literature, manually or automatically switch between the open state, the closed state, and the ground state, and there is still room for improvement in the mechanism that ensures the switching operation to be performed, such as a reduction in size.

SUMMARY

The switch according to an aspect of the embodiment includes a first contact that switches between an open state and a closed state, a second contact that switches between an open state and a ground state, an operating lever, and a rotating member that rotates for a predetermined angle in accordance with an operation of the operating lever. Furthermore, the switch includes a first cam that opens and closes the first contact by rotating in conjunction with a rotation of the rotating member in one direction and a second cam that opens and closes the second contact by rotating in conjunction with a rotation of the rotating member in another direction.

DESCRIPTION OF EMBODIMENTS

Figure 1:
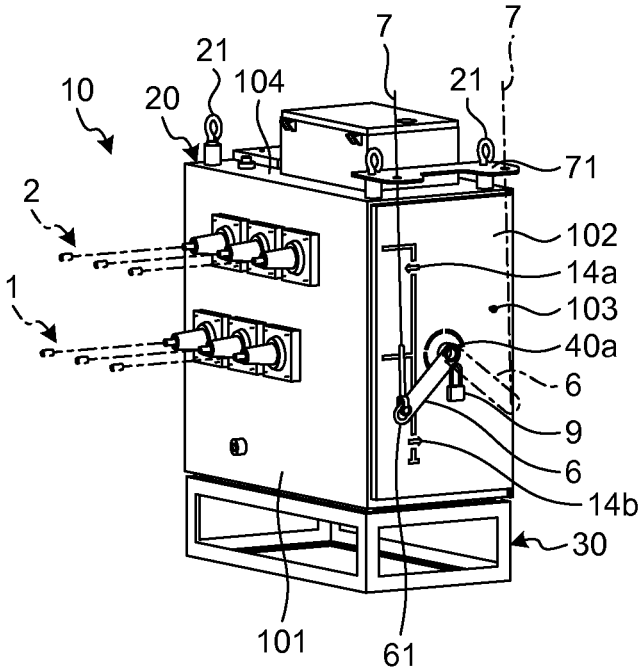
FIG. 1 is an explanatory diagram illustrating the appearance of a switch according to an embodiment.
Figure 2:
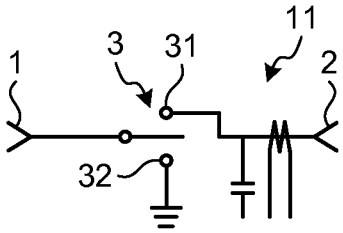
FIG. 2 is a circuit diagram of the switch.
Figure 3:
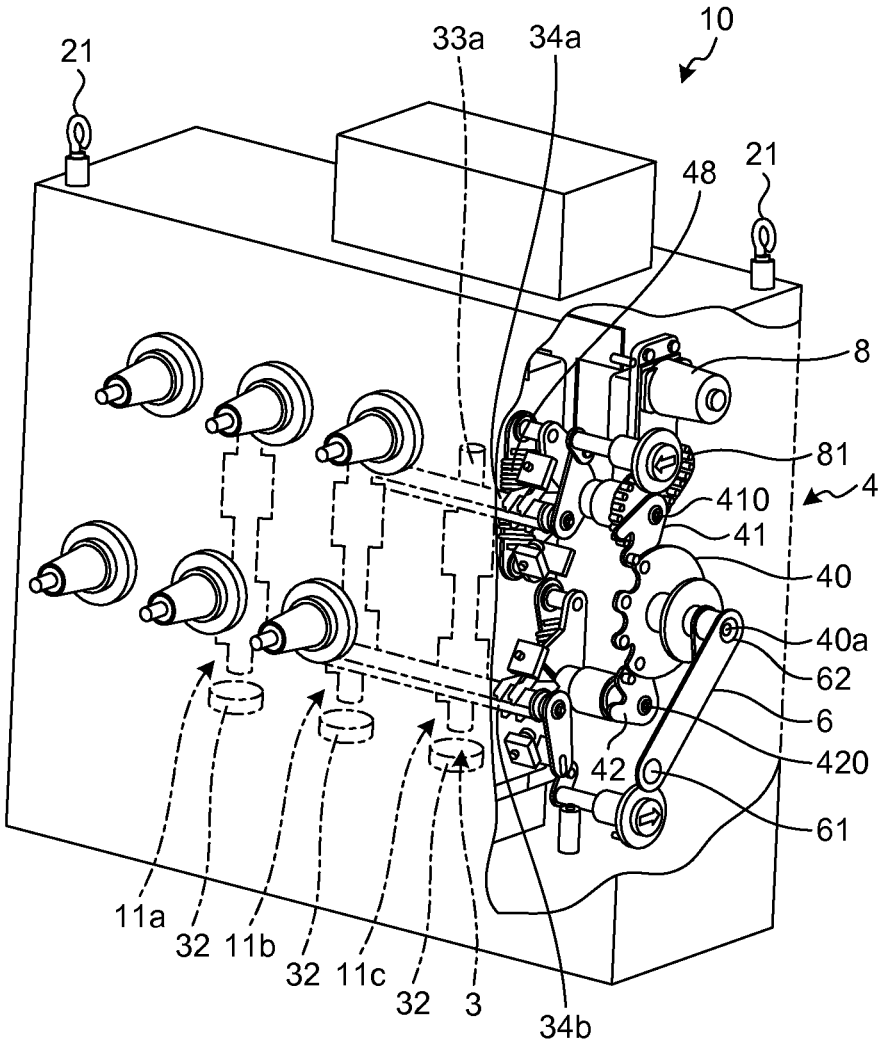
FIG. 3 is an explanatory diagram illustrating an operating unit of the switch.
Figure 4:
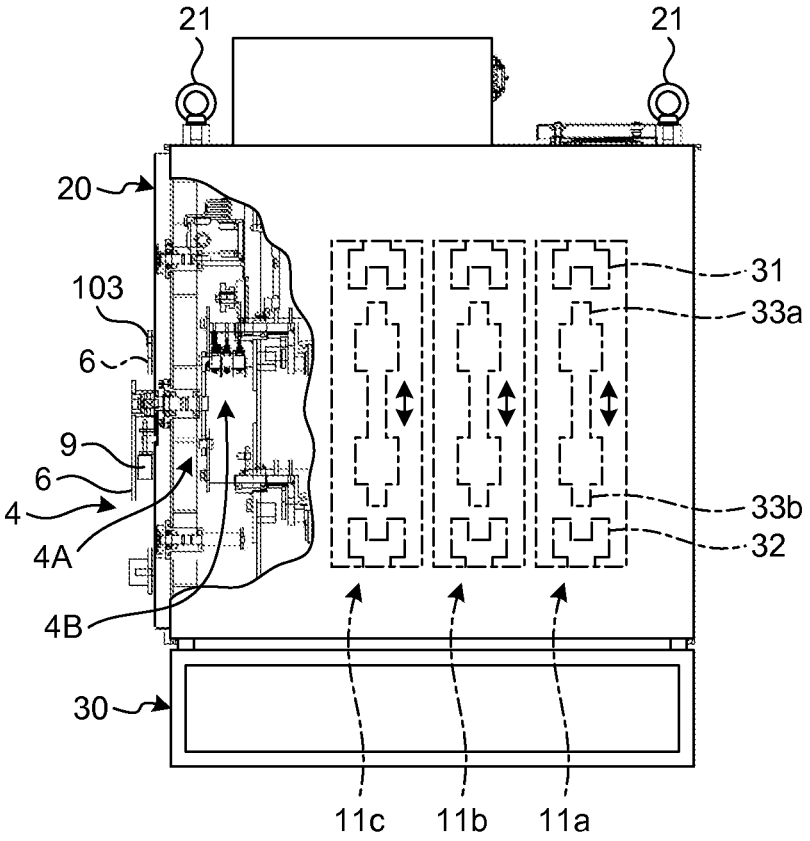
FIG. 4 is an explanatory diagram illustrating the internal structure of the whole switch.

Hereinafter, an embodiment of a switch disclosed in the present application will be explained in detail with reference to the drawings. FIG. 1 is an explanatory diagram illustrating the appearance of a switch 10 according to the embodiment. FIG. 2 is a circuit diagram of the switch 10. FIG. 3 is an explanatory diagram illustrating an operating unit 4 of the switch 10 and FIG. 4 is an explanatory diagram illustrating the internal structure of the whole switch 10. In the following, an explanation will be given of a case where the switch 10 is, for example, an earth switch provided underground; however, this invention is not limited to this embodiment.

As illustrated in FIG. 1, the switch 10 according to the present embodiment includes a rectangular box-shaped casing 20 fixed on an arrangement frame 30 and includes therein a switching device 11 represented by the circuit illustrated in FIG. 2. Specifically, the switching device 11 is provided with a switching unit 3, which includes a first contact 31 and a second contact 32, in the middle of the circuit that connects between a first feeder 1 and a second feeder 2. The first contact 31 switches between the open state and the closed state. The second contact 32 switches between the open state and the ground state. Normally, when maintenance is performed on the switch 10, the second contact 32 is closed so as to be in the ground state.

The casing 20 of the switch 10 according to the present embodiment is filled with an insulating gas. As illustrated in FIG. 3, the switching device 11, which includes a first switching device 11*a*, a second switching device 11*b*, and a third switching device 11*c* corresponding to three phases (U phase, V phase, and W phase), respectively, is accommodated in the casing 20. In this embodiment, $SF_6$ (sulfur hexafluoride) is used as the insulating gas; however, it can be appropriately selected.

The switching devices 11*a* to 11*c* are arranged in parallel in the longitudinal direction of the casing 20 and each include the first contact 31 and the second contact 32 as the switching unit 3. The switching devices 11*a* to 11*c* are operatively connected to the operating unit 4 that opens and closes the first contact 31 and the second contact 32. In the present embodiment, each of the switching devices 11*a* to 11*c* is generically referred to as the switching device 11 in some cases.

As illustrated in FIG. 1, the first feeder 1 and the second feeder 2 to be a main wiring are connected to a main surface 101 on one side of the casing 20 for each of the three phases (U phase, V phase, and W phase). A rotating shaft 40*a*, which is operatively connected to the switching devices 11*a* to 11*c*, is rotatably provided in a projecting manner on a side surface 102 on one side of the casing 20.

As illustrated in FIG. 1 and FIG. 3, the base end portion of an operating lever 6 is attached to the rotating shaft 40*a* such that the rotating shaft 40*a* can be rotated from the outside. Specifically, while a connection hole 62 is formed in the base end portion of the operating lever 6, a circular wire connection hole 61 is formed in the tip portion of the operating lever 6 and one end of an operating wire 7 extending upward is connected to the wire connection hole 61.

The rotating shaft 40*a* can be rotated via the operating lever 6, for example, by pulling up the operating wire 7 extended toward the ground. As illustrated in FIG. 1, an indicating unit 14*a*, which indicates the switching condition of the first contact 31, and an indicating unit 14*b*, which indicates the switching condition of the second contact 32, are provided on the side surface 102.

The operating lever 6 can be mounted, as illustrated in FIG. 1, selectively in a first mounted state (indicated by the solid line) and a second mounted state (indicated by the dashed line), which is shifted approximately 90° counterclockwise from the first mounted state. In other words, the connection hole 62 can be connected in any of the first mounted state, which defines the rotation direction of a rotating member 40 of a cam mechanism 4A to be described later in a first direction, and the second mounted state, which defines the rotation direction of the rotating member 40 in a second direction. Specifically, the tip of the rotating shaft 40*a* is processed into a rectangular shape (see FIG. 5) and the connection hole 62 of the operating lever 6 is formed into a rectangular shape corresponding to the rotating shaft 40*a*.

In this embodiment, the switching device 11 can be set to on (closed circuit) in the first mounted state and the switching device 11 can be grounded in the second mounted state. In other words, it is possible to switch between the open state and the closed state with the first contact 31 in the first mounted state and switch between the open state and the ground state with the second contact 32 in the second mounted state.

It is not common to set the switching device 11 to the ground state; therefore, as illustrated in FIG. 1 and FIG. 4, a lock key 9 needs to be released to set the operating lever 6 to the second mounted state so that the operating lever 6 is not set to the second mounted state by mistake. As illustrated in FIG. 4, in a non-use state, the operating lever 6 can be stored by being hooked on a pin-like hook 103 provided on the side surface 102 of the casing 20.

Eye bolts 21 for suspending the switch 10 are attached at four corners of a top surface 104 of the casing 20. A wire guide 71, which guides the operating wire 7, is provided to extend between two of the eye bolts 21 and 21 located on the side surface 102 side on which the rotating shaft 40*a* is provided in a projecting manner.

Figure 5:
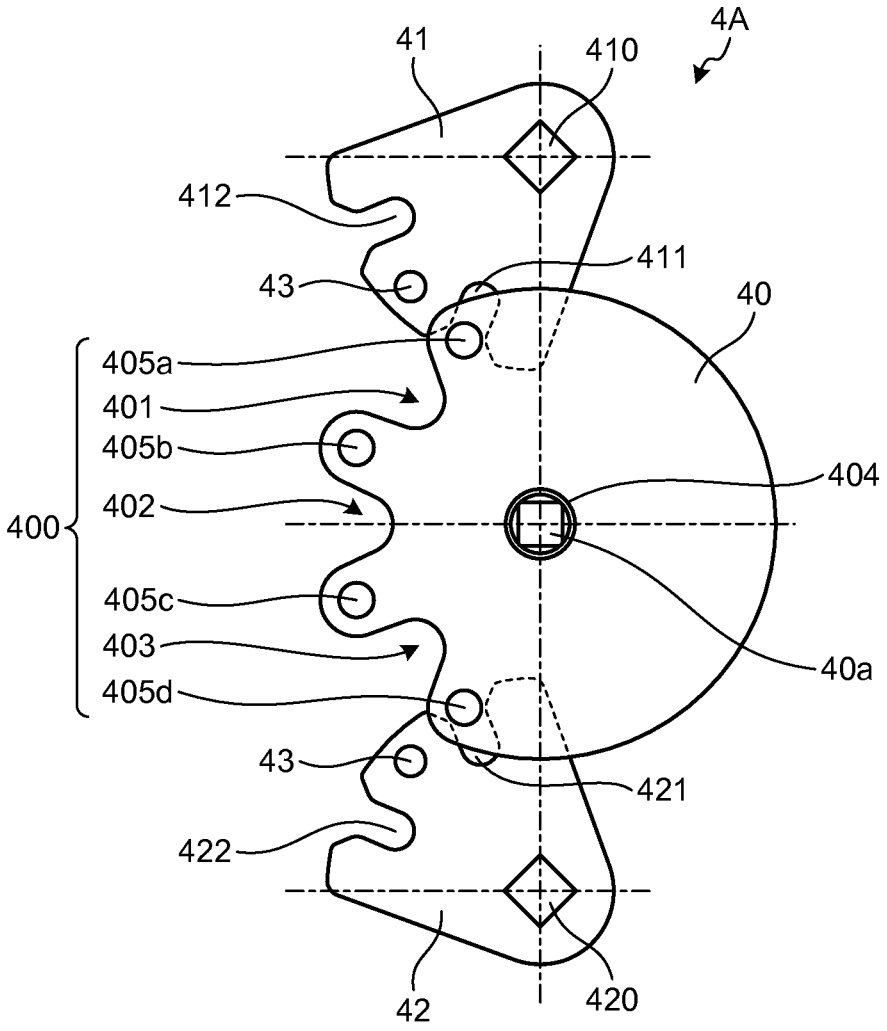
FIG. 5 is an explanatory diagram illustrating a cam mechanism of the operating unit.
Figure 6A:
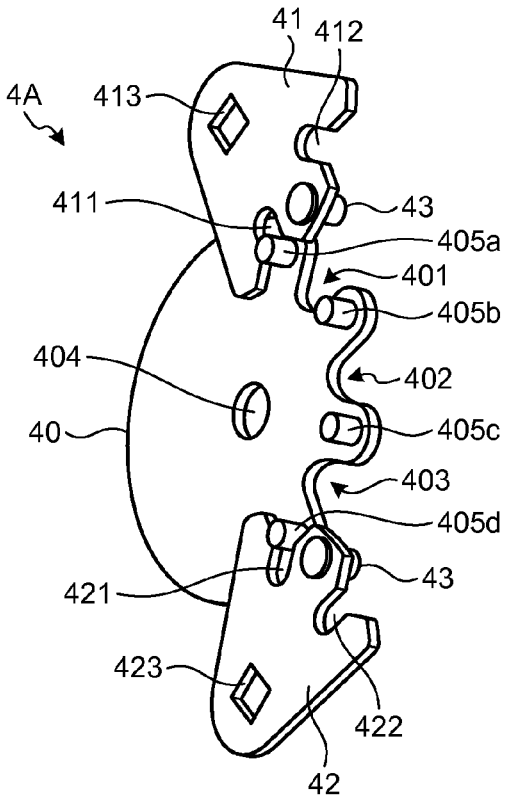
FIG. 6A is a perspective view of the cam mechanism as viewed from one side direction.
Figure 6B:
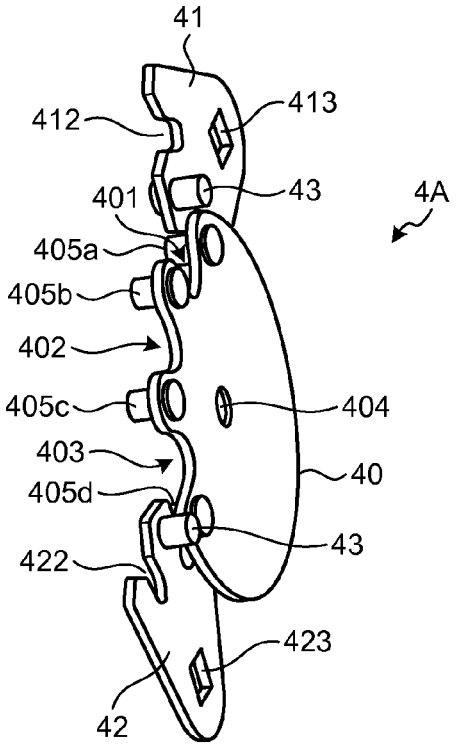
FIG. 6B is a perspective view of the cam mechanism as viewed from the other side direction.
Figure 7:
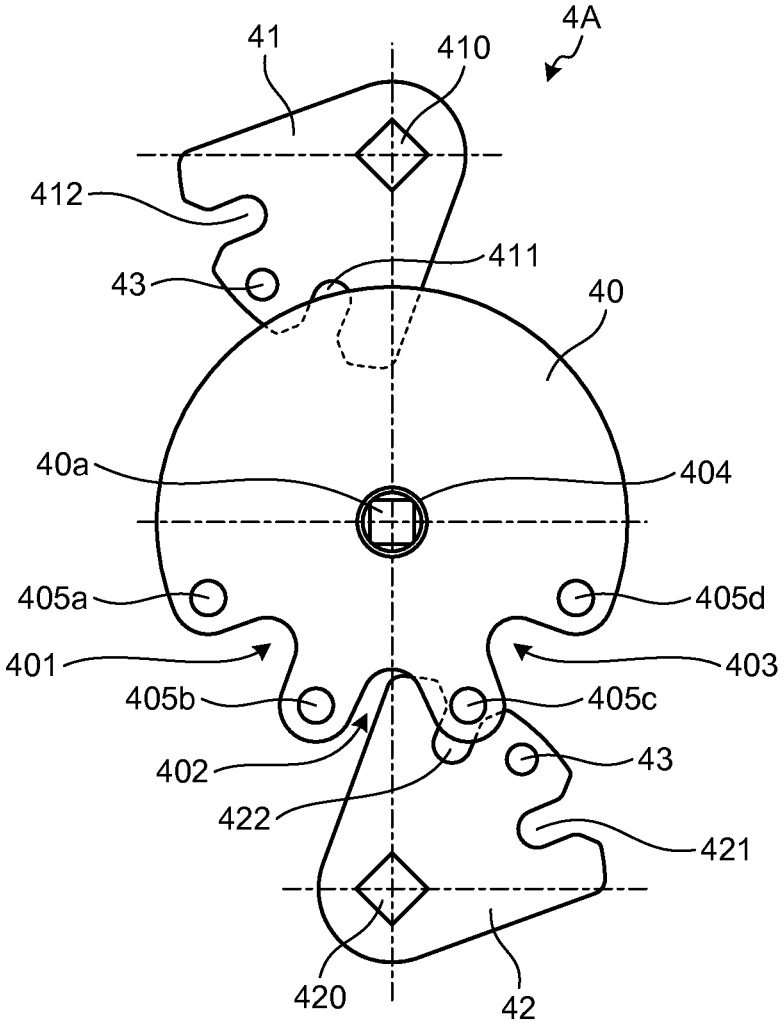
FIG. 7 is an explanatory diagram illustrating an operating state of the cam mechanism.

The configuration of the operating unit 4 including the rotating shaft 40*a* and the operating lever 6 described above and the operation of the switching device 11 via the operating unit 4 will be described with reference to FIG. 3 to FIG. 9. FIG. 5 is an explanatory diagram illustrating the cam mechanism 4A of the operating unit 4. FIG. 6A is a perspective view of the cam mechanism 4A as viewed from one side direction, FIG. 6B is a perspective view of the cam mechanism 4A as viewed from the other side direction, and FIG. 7 is an explanatory diagram illustrating an operating state of the cam mechanism 4A.

As illustrated in FIG. 3 and FIG. 4, the switching device 11*a*, 11*b*, and 11*c* accommodated in the casing 20 each include the first contact 31 and the second contact 32. The first contact 31 can switch between the open state and the closed state by being separated from and coming into contact with a pin-like first switching member 33*a*, and the second contact 32 can switch between the open state and the ground state by being separated from and coming into contact with a pin-like second switching member 33*b*.

The first switching member 33*a* and the second switching member 33*b* are arranged coaxially with each other in substantially the vertical direction, and the first switching member 33*a* is connected to a first transmission shaft 34*a* and the second switching member 33*b* is connected to a second transmission shaft 34*b*. In FIG. 4, the first and second transmission shafts 34*a* and 34*b* are not shown.

The operating unit 4 is a mechanism that rotates the first transmission shaft 34*a* and the second transmission shaft 34*b* around the shaft center. In other words, the operating unit 4 includes the operating lever 6 and the rotating shaft 40*a* that rotates for a predetermined angle in accordance with the operation of the operating lever 6, and moreover includes the cam mechanism 4A that includes the rotating member 40 fixed to the rotating shaft 40*a*.

As illustrated in FIG. 5 and FIGS. 6A and 6B, the cam mechanism 4A includes a first cam 41 and a second cam 42. The first cam 41 opens and closes the first contact 31 by rotating in conjunction with the rotation of the rotating member 40 in one direction (in this embodiment, clockwise). The second cam 42 opens and closes the second contact 32 by rotating in conjunction with the rotation of the rotating member 40 in the other direction (counterclockwise). The state of the cam mechanism 4A illustrated in FIG. 5 is a neutral state where both the first contact 31 and the second contact 32 are open. Herein, a first switching means corresponds to, for example, the first cam 41 and the first contact 31 and is a means for switching between an open state and a closed state. A second switching means corresponds to, for example, the second cam 42 and the second contact 32 and is a means for switching between an open state and a ground state. Moreover, an operating means corresponds to, for example, the operating lever 6 and the rotating member 40. The operating means is a means for selecting one of the first switching means and the second switching means, causing only the first switching means to operate in a case where the selected means is the first switching means, and causing only the second switching means to operate in a case where the selected means is the second switching means. In this case, when the selected means is changed, the selected means is changed to the first switching means or the second switching mean via the open state.

The first cam 41 is fixed to a first rotating shaft 410 and the second cam 42 is fixed to a second rotating shaft 420. The first cam 41 and the second cam 42 are arranged to face each other with the rotating member 40 therebetween such that the first rotating shaft 410, the second rotating shaft 420, and the rotating shaft 40*a* of the rotating member 40 are located substantially along the same straight line. In FIGS. 6A and 6B, the rotating shaft 40*a*, the first rotating shaft 410, and the second rotating shaft 420 are not shown, and, as illustrated in FIGS. 6A and 6B, a rotating shaft connection hole 404 is provided in the rotating member 40 and rotating shaft connection holes 413 and 423 are provided in the first cam 41 and the second cam 42, respectively.

The rotating member 40 is formed into substantially a disk shape with the rotating shaft 40*a* (the rotating shaft connection hole 404) as the center and is provided with an engaging portion 400, which is engaged with the first cam 41 and the second cam 42, along substantially half the outer periphery. In other words, first to fourth engaging pins 405*a* to 405*d* are provided in a projecting manner along substantially half the outer periphery of the rotating member 40. A first recessed portion 401 is formed between the adjacent first and second engaging pins 405*a* and 405*b*. In a similar manner, a second recessed portion 402 is formed between the second and third engaging pins 405*b* and 405*c* and a third recessed portion 403 is formed between the third and fourth engaging pins 405*c* and 405*d*.

Moreover, a first engaging recessed portion 411, which is engaged with the first engaging pin 405*a*, and a second engaging recessed portion 412, which is engaged with the second engaging pin 405*b*, are formed in the first cam 41. Furthermore, a first engaging recessed portion 421, which is engaged with the fourth engaging pin 405*d*, and a second engaging recessed portion 422, which is engaged with the third engaging pin 405*c*, are formed in the second cam 42.

Moreover, the first rotating shaft 410, to which the first cam 41 is fixed, is operatively connected to the first transmission shaft 34*a* via a first toggle mechanism 4B1 to be described later (see FIG. 3 and FIG. 4). Furthermore, the second rotating shaft 420, to which the second cam 42 is fixed, is operatively connected to the second transmission shaft 34*b* via a second toggle mechanism 4B2 to be described later (see FIG. 3 and FIG. 4).

With this configuration, when the rotating member 40 rotates clockwise, first, the first engaging pin 405*a* is engaged with the first engaging recessed portion 411 of the first cam 41 and then the second engaging pin 405*b* is engaged with the second engaging recessed portion 412, thereby rotating the first cam 41 counterclockwise.

In contrast, when the rotating member 40 rotates counterclockwise, first, the fourth engaging pin 405*d* is engaged with the first engaging recessed portion 421 of the second cam 42 and then the third engaging pin 405*c* is engaged with the second engaging recessed portion 422, thereby rotating the second cam 42 clockwise.

Moreover, in the present embodiment, as illustrated in FIG. 3, a motor 8 that is a drive source, which is operatively connected to the first cam 41, is included. Specifically, the first cam 41 can be directly rotated by power transmission from the motor 8 via a not-shown speed reducer without using the rotating member 40 that rotates in conjunction with the operation of the operating lever 6. In other words, the switch 10 according to the present embodiment can perform switching between the open state and the closed state by directly rotating the first cam 41 by remotely driving the motor 8. The motor 8 is one example of a drive means, and the drive means is not limited to a motor and may be an actuator, such as an air cylinder or a hydraulic cylinder. Herein, the motor 8 corresponds to a drive means for directly operating the first switching means without using the operating means that includes the rotating member 40.

In contrast, the switching between the open state and the ground state is restricted such that it is only performed by a manual operation using the operating lever 6.

Moreover, the first cam 41 includes a stopper that restricts the rotation of the first cam 41. In other words, as illustrated in FIG. 5 to FIG. 6B, a stopper pin 43 is provided in a projecting manner on the first cam 41 between the first engaging recessed portion 411 and the second engaging recessed portion 412 in a direction opposite to the first to fourth engaging pins 405*a* to 405*d* of the rotating member 40. The stopper pin 43 restricts the rotation of the first cam 41 by coming into contact with the rotating member 40 under a predetermined condition. The shape of the stopper is not limited to a pin shape, such as the shape of the stopper pin 43, and it is sufficient that the stopper has a projected shape to function as a stopper by coming into contact with the rotating member 40.

In the present embodiment, the predetermined condition is that, in the ground state in which the second contact 32 is closed, the force that rotates the first cam 41 in a direction that sets the first contact 31 to the closed state is acting forcibly. Therefore, in this case, the stopper pin 43 can restrict the rotation of the first cam 41 by coming into contact with the rotating member 40. In this case, the first switching means includes an operation restricting means for restricting an operation of the first switching means when a force, which causes the first switching means to operate in a direction that closes the first switching means so as to be in a closed state, is applied forcibly to the first switching means in a state where the current state is the ground state. Herein, the operation restricting means corresponds to the stopper pin 43 that is a stopper.

In other words, in the ground state in which the second contact 32 is closed, as illustrated in FIG. 7, the cam mechanism 4A is in a state where the rotating member 40 rotates approximately 90° counterclockwise from the neutral state in FIG. 5 and the second cam 42 rotates approximately 90° clockwise. On the other hand, the first cam 41 is not changed from the neutral state in FIG. 5.

A case is considered where a command signal is sent to the motor 8 from the outside, for example, due to erroneous operation, and, as described above, the force that rotates the first cam 41 in a direction (counterclockwise) that closes the first contact 31 is applied to the first cam 41 by the motor 8 from the state illustrated in FIG. 7. In this case, as illustrated in FIG. 7, because the stopper pin 43 comes into contact with the peripheral surface of the rotating member 40, further rotation of the first cam 41 is prevented. In the present embodiment, when the rotation of the first cam 41 is restricted, for example, for 2 seconds, transmission of a command signal to the motor 8 is controlled to be stopped.

In the present embodiment, because the first cam 41 and the second cam 42 are formed by using the same members, the stopper pin 43 is also provided in a projecting manner on the second cam 42; however, the stopper pin 43 provided in a projecting manner on the second cam 42 may be absent.

Figure 8:
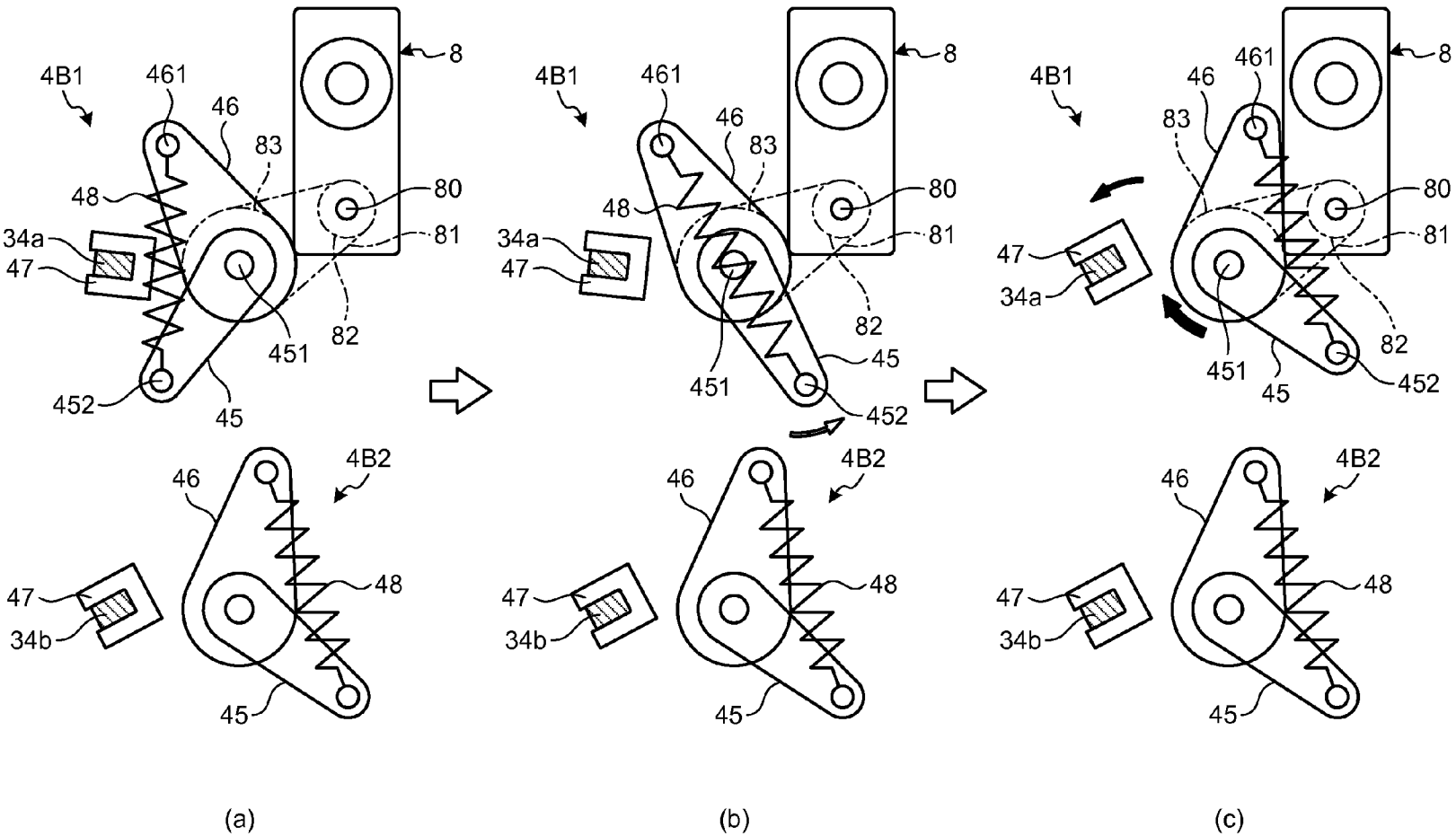
FIG. 8 and FIG. 9 are schematic explanatory diagrams illustrating an example of the operation of a toggle mechanism of the operating unit.
Figure 9:
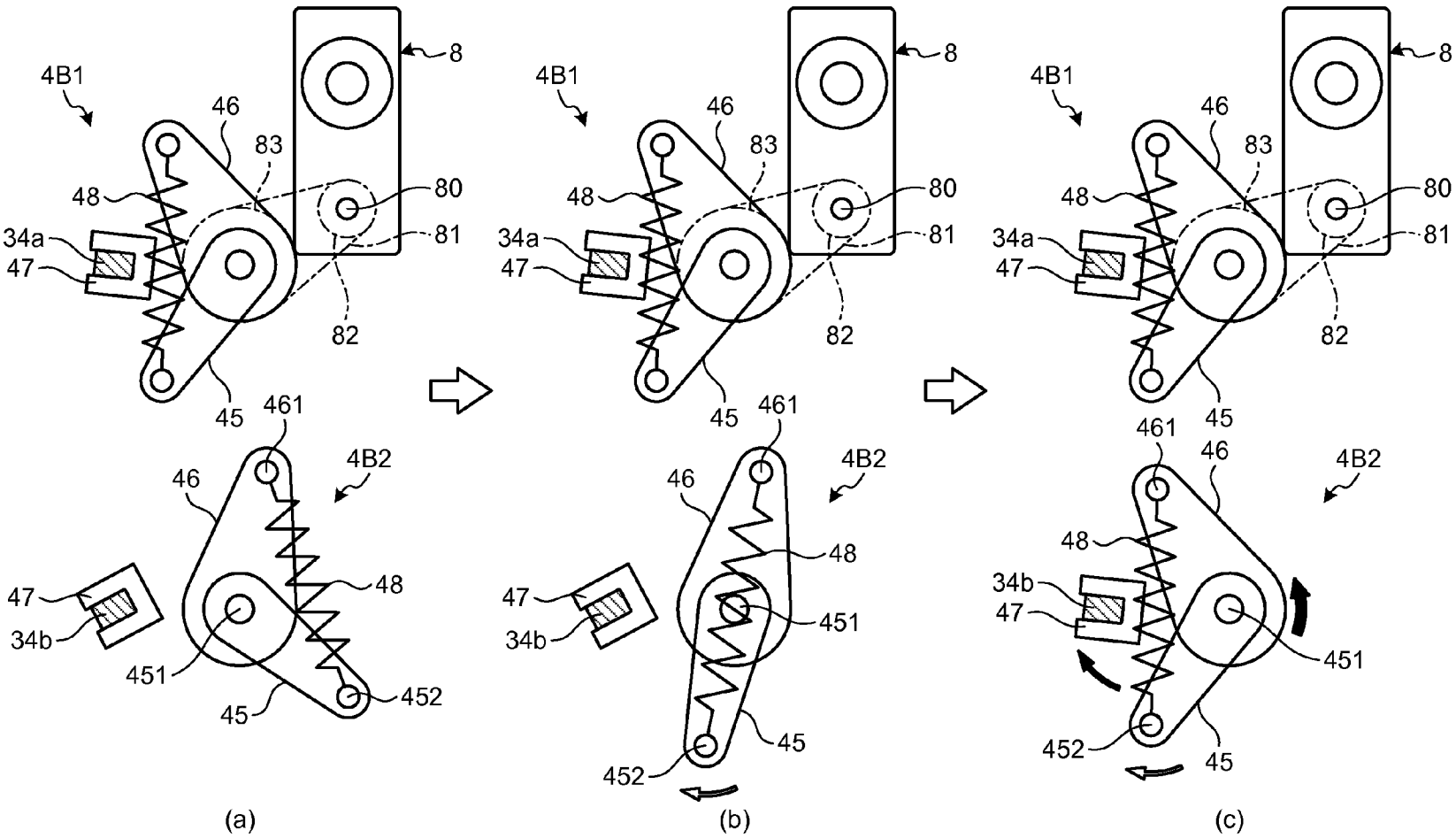

Moreover, the operating unit 4 includes a toggle mechanism 4B (the first toggle mechanism 4B1 and the second toggle mechanism 4B2). The toggle mechanism 4B can instantaneously drive the first switching member 33*a* and the second switching member 33*b*, which are provided to be able to come into contact with and separate from the first contact 31 and the second contact 32, in the closing direction in cooperation with the cam mechanism 4A. FIG. 8 and FIG. 9 are schematic explanatory diagrams illustrating an example of the operation of the toggle mechanism 4B of the operating unit 4, in which FIG. 8 illustrates the operation of the first toggle mechanism 4B1 and FIG. 9 illustrates the operation of the second toggle mechanism 4B2.

As illustrated in FIG. 8, the operating unit 4 of the switch 10 includes the first toggle mechanism 4B1, which is operatively connected to the first transmission shaft 34*a* connected to the first switching members 33*a*, which open and close the first contacts 31, and which is operatively connected to the first rotating shaft 410, to which the first cam 41 is fixed. Moreover, as illustrated in FIG. 9, the operating unit 4 includes the second toggle mechanism 4B2, which is operatively connected to the second transmission shaft 34*b* connected to the second switching members 33*b*, which open and close the second contacts 32, and which is operatively connected to the second rotating shaft 420, to which the second cam 42 is fixed.

First, the configuration and the operation of the first toggle mechanism 4B1 will be described. As illustrated in FIG. 8, the first toggle mechanism 4B1 is such that a first plate 45 is fixed to a connecting shaft 451 that is operatively connected to the first rotating shaft 410 of the first cam 41. Moreover, a second plate 46 is rotatably provided to the connecting shaft 451. Furthermore, as illustrated in FIG. 8, a spring 48 is stretched between a shaft body 452 provided at the tip portion of the first plate 45 and a shaft body 461 provided at one end of the second plate 46 that faces the shaft body 452 with a third plate 47 therebetween.

Moreover, the second plate 46 is formed to be able to interact with the third plate 47 that supports the first transmission shaft 34*a*. For example, when the first transmission shaft 34*a* is in a first posture ((a) and (b) of FIG. 8), the first switching member 33*a* is in the open state, and when the first transmission shaft 34*a* takes a second posture ((c) of FIG. 8), the first switching member 33*a* comes into contact with the first contact 31 so as to be in the closed state.

Moreover, a first sprocket 83 is fixed to the connecting shaft 451 of the first toggle mechanism 4B1 along with the first plate 45 and an endless chain 81 is wound between the first sprocket 83 and a second sprocket 82 fixed to a drive shaft 80 of the motor 8. Therefore, when the motor 8 is driven, the connecting shaft 451 can be rotated via the first sprocket 83, and as a result, the first plate 45 can be rotated.

The operation of the first toggle mechanism 4B1 in the case of switching from the open state to the closed state will be described. For closing the first contact 31, the motor 8 is driven from the initial state illustrated in (a) of FIG. 8 to rotate the first plate 45 counterclockwise as illustrated in (b) of FIG. 8.

Then, the spring 48 stretched between the first plate 45 and the second plate 46 is gradually extended and the maximum tension occurs in the state illustrated in (b) of FIG. 8. When the first plate 45 is further rotated counterclockwise due to the driving of the motor 8, the spring 48 exceeds the dead point and the spring 48 rapidly contracts. With the contraction of the spring 48, the second plate 46 formed to be able to interact with the third plate 47 instantaneously rotates clockwise around the shaft body 461 and swings the first transmission shaft 34*a* counterclockwise as illustrated in (c) of FIG. 8. With this sequence of operations, the first switching member 33*a* operatively connected to the first transmission shaft 34*a* comes into contact with the first contact 31 so as to be in the closed state. In the present embodiment, switching is performed by using the motor 8; however, it is also possible to perform switching from the open state to the closed state via the cam mechanism 4A by using the operating lever 6 to manually rotate the rotating member 40 clockwise without using the motor 8.

Next, the operation of the second toggle mechanism 4B2 in the case of switching from the open state to the ground state will be described with reference to FIG. 1, FIG. 3, and FIG. 9. Although the second toggle mechanism 4B2 is different from the first toggle mechanism 4B1 in that it is not connected to the motor 8, the basic structure of the second toggle mechanism 4B2 is the same as that of the first toggle mechanism 4B1; therefore, the components that achieve the same function as those of the first toggle mechanism 4B1 are denoted by the same reference numerals and an explanation of the configuration thereof is omitted.

The posture of the second transmission shaft 34*b* in (a) and (b) of FIG. 9 is a first posture, in which the second switching member 33*b* is in the open state. In contrast, the posture of the second transmission shaft 34*b* illustrated in (c) of FIG. 9 is a second posture. When the second transmission shaft 34*b* takes the second posture, the second switching member 33*b* comes into contact with the second contact 32 so as to be in the ground state.

The operation of the second toggle mechanism 4B2 in the case of switching from the open state to the ground state will be described. For switching from the open state to the ground state, a manual operation by using the operating lever 6 is performed.

First, the operating lever 6 is reattached to the rotating shaft 40*a* of the rotating member 40 such that the operating lever 6 is in the first mounted state indicated by the dashed line in FIG. 1. Then, the operating lever 6 is rotated counterclockwise by pulling up the operating wire 7, thereby rotating the rotating member 40 of the cam mechanism 4A counterclockwise. Consequently, the second cam 42 rotates clockwise (see FIG. 3, FIG. 5, and FIG. 7) and the first plate 45 also rotates clockwise, as illustrated in (b) of FIG. 9, from the initial state illustrated in (a) of FIG. 9.

Then, the spring 48 stretched between the first plate 45 and the second plate 46 is gradually extended and the maximum tension occurs in the state illustrated in (b) of FIG. 9. When the operating lever 6 is further raised, the first plate 45 further rotates clockwise and the spring 48 exceeds the dead point. Then, the spring 48 rapidly contracts. With the contraction of the spring 48, the second plate 46 instantaneously rotates counterclockwise around the shaft body 461 and swings the second transmission shaft 34*b* clockwise as illustrated in (c) of FIG. 9. With this sequence of operations, the second switching member 33*b* operatively connected to the second transmission shaft 34*b* comes into contact with the second contact 32 so as to be in the ground state.

The switch 10 according to the present embodiment described above can perform switching between the open state and the closed state of the first contact 31 and between the open state and the ground state of the second contact 32 also by using one operating lever 6 with a simple mechanism. Therefore, the switch 10 buried underground can be reduced in size, have excellent operability, and have high reliability.

The switch 10 has been described above through the embodiment; however, for example, the configuration of the cam mechanism 4A and the toggle mechanism 4B of the operating unit 4, and the like can appropriately changed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A switch comprising;

a first contact that switches between an open state and a closed state;

a second contact that switches between an open state and a ground state;

an operating lever;

a rotating member that rotates for a predetermined angle in accordance with an operation of the operating lever;

a first cam that opens and closes the first contact by rotating in conjunction with a rotation of the rotating member in one direction;

a second cam that opens and closes the second contact by rotating in conjunction with a rotation of the rotating member in another direction; and a drive source that is operatively connected to only the first cam of the first cam and the second cam, and directly rotates the first cam without using the rotating member.

2. The switch according to claim 1, wherein the first cam includes a stopper that restricts a rotation of the first cam by coming into contact with the rotating member.

3. The switch according to claim 1, wherein the operating lever is configured to be detachably attached to a rotating shaft of the rotating member.

4. The switch according to claim 1, wherein the rotating member is formed into substantially a disk shape with a rotating shaft as a center and includes an engaging portion, which is engaged with the first cam and the second cam, along substantially half an outer periphery.

5. The switch according to claim 4, wherein the first cam is fixed to a first rotating shaft that is operatively connected to the first contact, the second cam is fixed to a second rotating shaft that is operatively connected to the second contact, the first cam and the second cam are arranged with the rotating member therebetween such that the first rotating shaft, the second rotating shaft, and the rotating shaft of the rotating member are located substantially along a same straight line, and each of the first cam and the second cam includes a recessed portion that is engaged with an engaging pin formed in the engaging portion of the rotating member.

6. The switch according to claim 5, further comprising:

a first toggle mechanism that is operatively connected to a first transmission shaft connected to a switching member for the first contact and is operatively connected to the first rotating shaft, to which the first cam is fixed; and a second toggle mechanism that is operatively connected to a second transmission shaft connected to a switching member for the second contact and is operatively connected to the second rotating shaft, to which the second cam is fixed.

7. A switch comprising:

a first contact that switches between an open state and a closed state;

a second contact that switches between an open state and a ground state;

an operating lever;

a rotating member that rotates for a predetermined angle in accordance with an operation of the operating lever;

a first cam that opens and closes the first contact by rotating in conjunction with a rotation of the rotating member in one direction; and a second cam that opens and closes the second contact by rotating in conjunction with a rotation of the rotating member in another direction, wherein the operating lever is configured to be detachably attached to a rotating shaft of the rotating member, and is configured to select one of a first mounted state and a second mounted state, the first mounted state is a state in which the rotating member is rotated in the one direction, and the second mounted state is a state in which the rotating member is rotated in the other direction.

8. The switch according to claim 7, wherein the first cam includes a stopper that restricts a rotation of the first cam by coming into contact with the rotating member.

9. The switch according to claim 7, wherein the rotating member is formed into substantially a disk shape with a rotating shaft as a center and includes an engaging portion, which is engaged with the first cam and the second cam, along substantially half an outer periphery.

10. The switch according to claim 9, wherein the first cam is fixed to a first rotating shaft that is operatively connected to the first contact, the second cam is fixed to a second rotating shaft that is operatively connected to the second contact, the first cam and the second cam are arranged with the rotating member therebetween such that the first rotating shaft, the second rotating shaft, and the rotating shaft of the rotating member are located substantially along a same straight line, and each of the first cam and the second cam includes a recessed portion that is engaged with an engaging pin formed in the engaging portion of the rotating member.

11. The switch according to claim 10, further comprising:

a first toggle mechanism that is operatively connected to a first transmission shaft connected to a switching member for the first contact and is operatively connected to the first rotating shaft, to which the first cam is fixed; and a second toggle mechanism that is operatively connected to a second transmission shaft connected to a switching member for the second contact and is operatively connected to the second rotating shaft, to which the second cam is fixed.

12. A switch comprising:

a first switching means for switching between an open state and a closed state;

a second switching means for switching between an open state and a ground state;

an operating means for selecting one of the first switching means and the second switching means, causing only the first switching means to operate in a case where a selected means is the first switching means, and causing only the second switching means to operate in a case where a selected means is the second switching means; and a drive means for directly operating only the first switching means of the first switching means and the second switching means without using the operating means.

13. The switch according to claim 12, wherein when the selected means is changed, the selected means is changed to the first switching means or the second switching mean via the open state.

14. The switch according to claim 12, wherein the first switching means includes an operation restricting means for restricting an operation of the first switching means when a force, which causes the first switching means to operate in a direction that closes the first switching means so as to be in a closed state, is applied forcibly to the first switching means in a state where a current state is the ground state.

* * * * *